US008353722B1

(12) United States Patent
Lan et al.

(10) Patent No.: US 8,353,722 B1
(45) Date of Patent: Jan. 15, 2013

(54) ELECTRICAL CONNECTOR

(75) Inventors: Rong-Qin Lan, New Taipei (TW); Li-Jun Xu, New Taipei (TW); Ming-Han Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/294,182

(22) Filed: Nov. 11, 2011

(51) Int. Cl.
*H01R 9/03* (2006.01)

(52) U.S. Cl. ..... 439/607.55; 439/607.35

(58) Field of Classification Search .. 439/607.35–607.4, 439/607.54, 607.55
See application file for complete search history.

(56) References Cited

U.S. PATENT DOCUMENTS 8,197,281 B2 * 6/2012 Yang ..... 439/499
8,202,120 B2 * 6/2012 Ko ..... 439/607.35
8,206,177 B2 * 6/2012 Chang ..... 439/607.35
8,246,383 B2 * 8/2012 Schmidt et al. ..... 439/607.35
8,277,253 B2 * 10/2012 Lee et al. ..... 439/607.32

* cited by examiner

*Primary Examiner* — Khiem Nguyen
(74) *Attorney, Agent, or Firm* — Lin & Associates IP, Inc.

(57) ABSTRACT

An electrical connector includes an insulating housing having a front surface concaved rearward to define a receiving chamber with a tongue board therein. Electrical terminals are disposed in the tongue board and elastically stretch into the receiving chamber. A frame-shaped holding shell is mounted in the receiving chamber. A shielding cover adapted for being connected to ground and punched from a metal board has a base board with a window being opened therein and a plurality of contact strips being formed and apart arranged to periphery edges of the base board. The base board is covered onto the front surface of the insulating housing with the window being communicated with the receiving chamber. The contact strips stretch freely outside the insulating housing. A shielding shell is put around the insulating housing and electrically connected with the shielding cover.

6 Claims, 5 Drawing Sheets

ELECTRICAL CONNECTOR

BACKGROUND OF THE INVENTION

1. Field of the Invention

The present invention relates to an electrical connector, and more particularly to an electrical connector capable of shielding electromagnetic interference.

2. The Related Art

With fast development of electronic technology, various electronic products and peripheral devices thereof are connected with each other with increasing frequency. So, an electrical connector is often used to achieve the connection between the electronic products and the peripheral devices thereof. The rapid developments of the electrical connector call for more stringent requirement to electromagnetic shielding effect of the electrical connector. A traditional method for shielding electromagnetic interference in the electrical connector is to utilize a metal shell to connect with ground. However, the metal shell is generally designed with an evenness outer structure that generally realizes a poor effect for filtering external electromagnetic interference. As a result, electromagnetic interference is often apt to happen in the electrical connector to affect signal communication between the electronic product and the peripheral device thereof. So, an electrical connector capable of overcoming the forgoing problem is required.

SUMMARY OF THE INVENTION

An object of the present invention is to provide an electrical connector. The electrical connector includes an insulating housing having a front surface concaved rearward to define at least one receiving chamber with a tongue board being protruded forward in a substantial middle of the receiving chamber. A bottom side of the tongue board defines a plurality of terminal fillisters each longitudinally penetrating rearward through the insulating housing. A plurality of electrical terminals each has a fastening arm fastened in a rear of the terminal fillister of the insulating housing, a contact arm extending forward from a front end of the fastening arm to be received in the terminal fillister with a free end thereof arching downward to elastically stretch into the receiving chamber, and a soldering tail extending downward from a rear end of the fastening arm to be located behind the insulating housing. At least one holding shell of a frame shape is mounted in the receiving chamber of the insulating housing and abuts against periphery inner sides of the receiving chamber, with the tongue board stretching in the holding shell and being apart from periphery plates of the holding shell. A shielding cover is adapted for being connected to ground and punched from a metal board. The shielding cover has a base board with at least one window being opened therein and a plurality of contact strips being formed and apart arranged to periphery edges of the base board. The base board is covered onto the front surface of the insulating housing with the window being communicated with an opened front end of the receiving chamber. The contact strips stretch freely outside the insulating housing. A shielding shell is put around the insulating housing and electrically connected with the shielding cover.

As described above, the shielding cover adapted for being connected to ground is covered on the front surface of the insulating housing to cooperate with the shielding shell so as to effectively shield external electromagnetic interference. Furthermore, the contact strips are formed and apart arranged to the periphery edges of the base board and stretch freely outside the insulating housing so as to achieve a good effect of filtering external electromagnetic interference. So, electromagnetic interference can be effectively avoided happening in the electrical connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
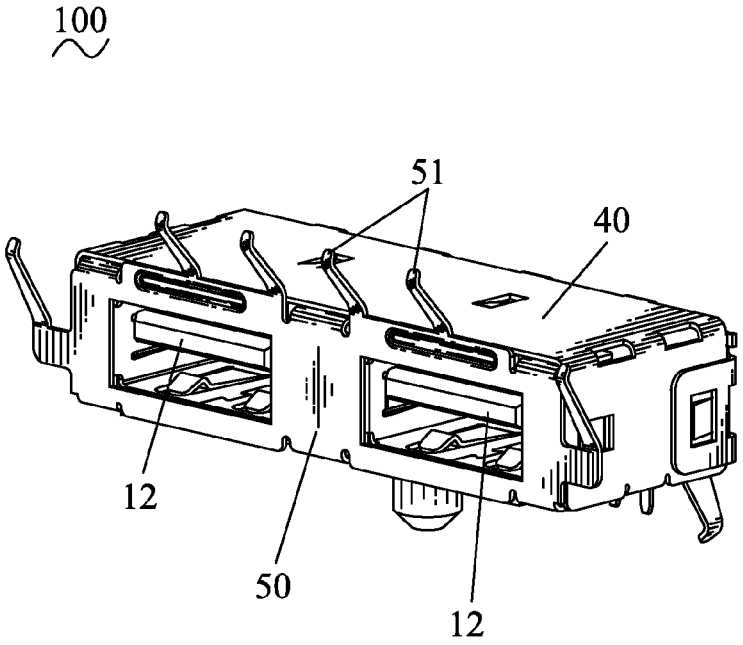
FIG. 1 is a perspective view of an electrical connector in accordance with an embodiment of the present invention.
Figure 2:
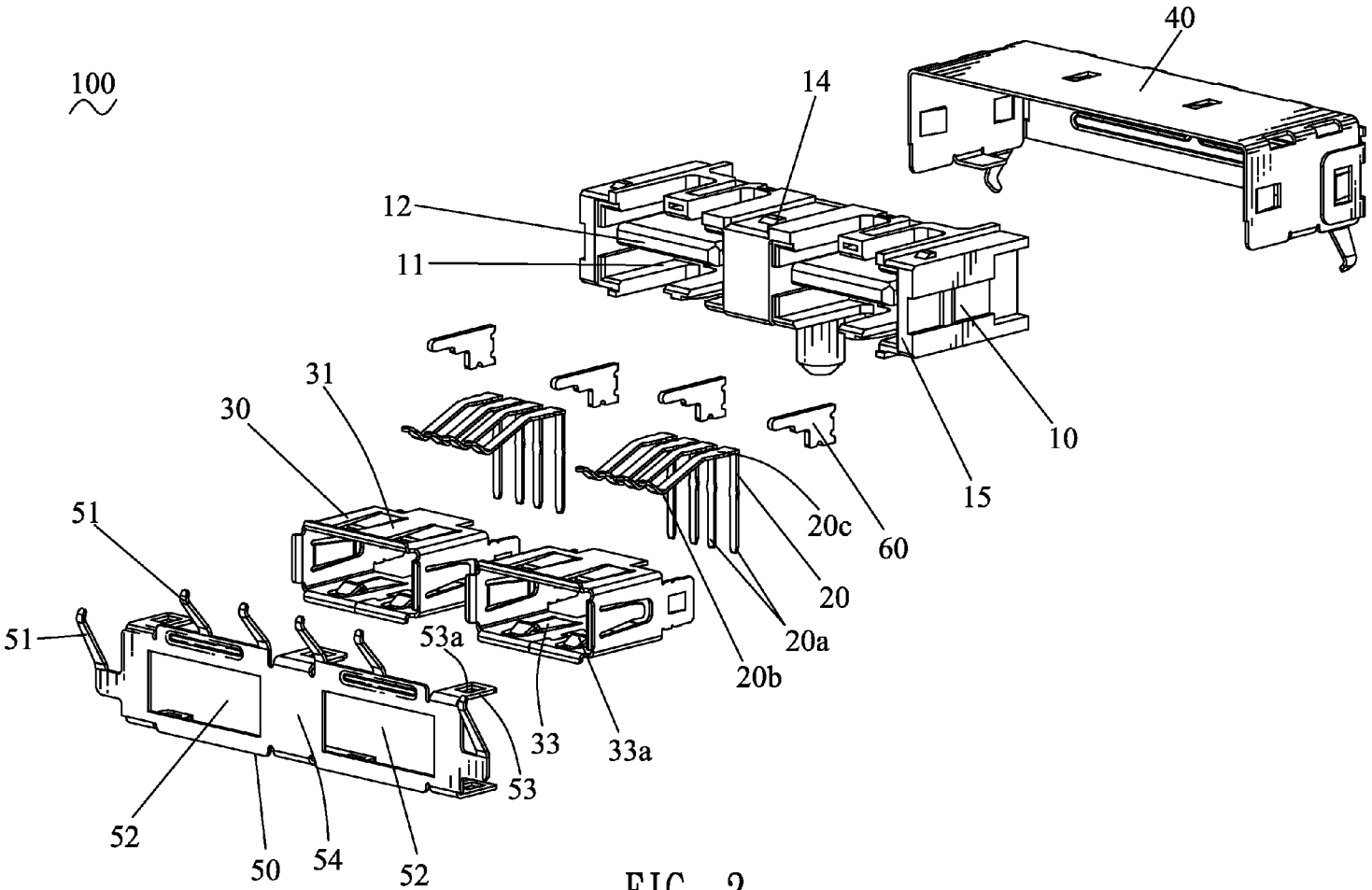
FIG. 2 is an exploded view of the electrical connector of FIG. 1.

Referring to FIG. 1 and FIG. 2, an electrical connector 100 in accordance with an embodiment of the present invention includes an insulating housing 10, a plurality of electrical terminals 20, two holding shells 30, a shielding shell 40 and a shielding cover 50.

Figure 5:
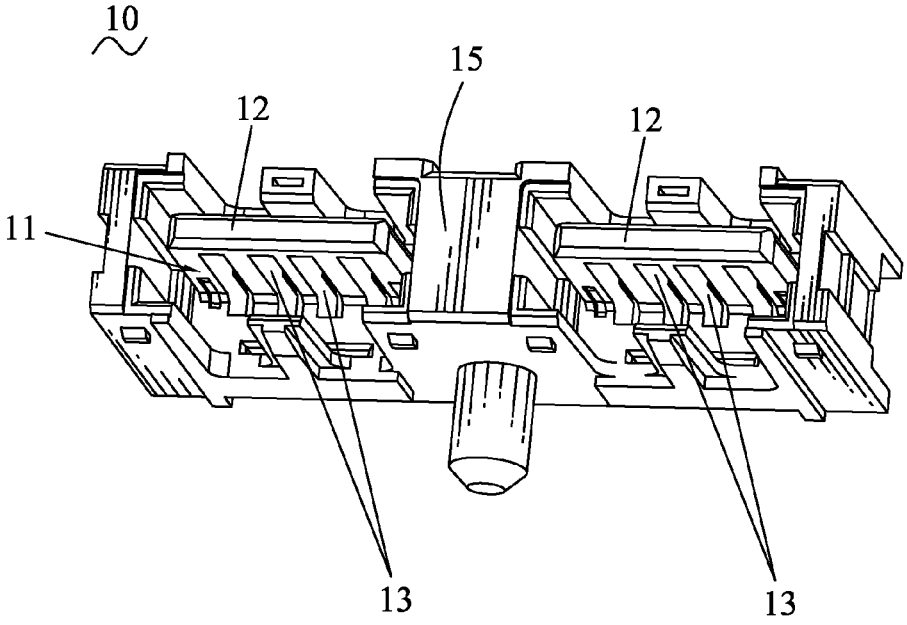
FIG. 5 is a perspective view of an insulating housing of the electrical connector of FIG. 2.

Referring to FIG. 2 and FIG. 5, the insulating housing 10 is of a substantially rectangular shape, and has a front surface 15 concaved rearward to apart define two receiving chambers 11 of rectangular ring shape seen from a front view. Accordingly, a rectangular tongue board 12 is formed in the middle of each receiving chamber 11. A front end of each receiving chamber 11 is opened freely for the convenience of insertion of a mating connector (not shown). A bottom side of the tongue board 12 defines a plurality of terminal fillisters 13 arranged at regular intervals along a transverse direction thereof, and each extending longitudinally to further penetrate rearward through the insulating housing 10.

Figure 3:
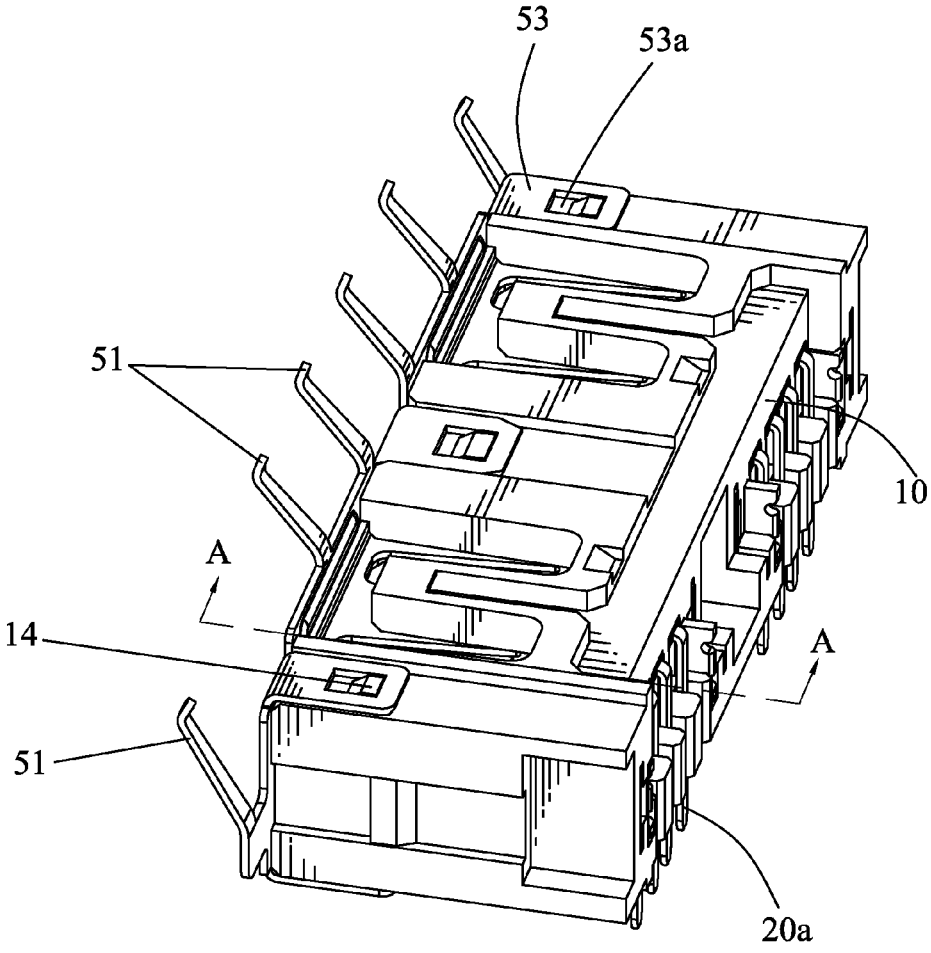
FIG. 3 is a perspective view of the electrical connector without a shielding shell shown in FIG. 1.

Referring to FIG. 2 and FIG. 3, the electrical terminal 20 has a fastening arm 20*c* fastened in a rear of the terminal fillister 13 of the insulating housing 10, a contact arm 20*b* extending forward from a front end of the fastening arm 20*c* to be received in the terminal fillister 13 with a free end thereof arching downward to elastically stretch into the receiving chamber 11 for electrically connecting with the mating connector, and a soldering tail 20*a* extending downward from a rear end of the fastening arm 20*c* and located behind the insulating housing 10.

Figure 4:
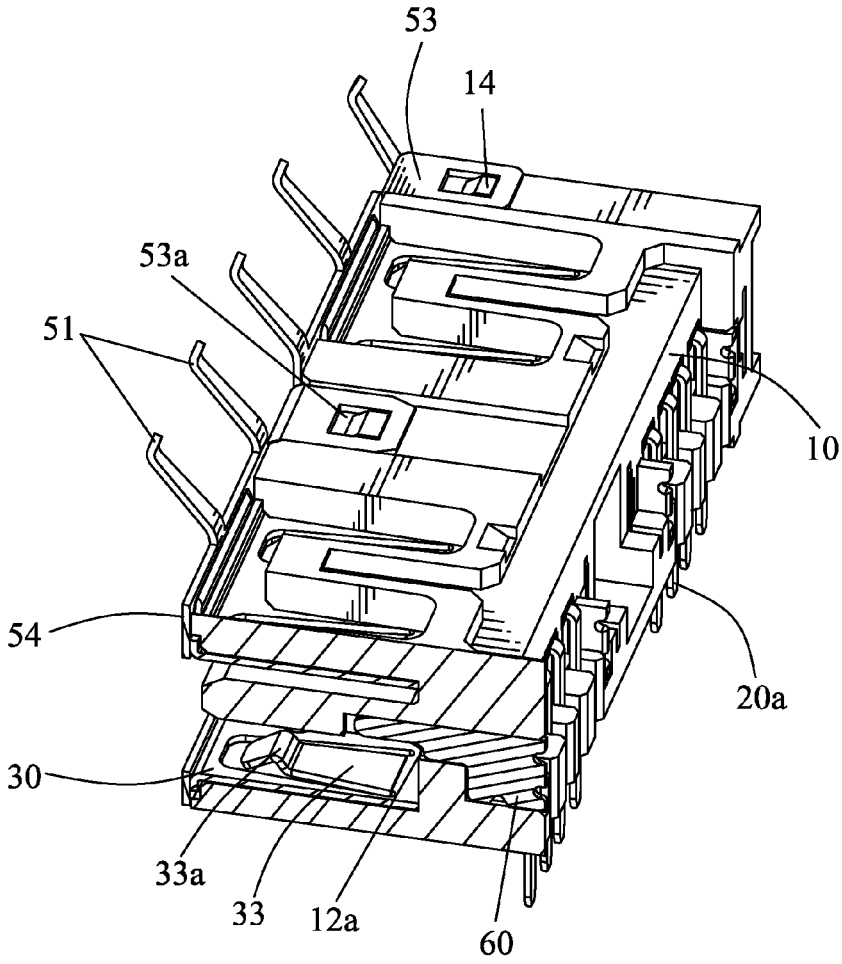
FIG. 4 is a sectional view of the electrical connector without the shielding shell of FIG. 3 along a line A-A.

Referring to FIG. 2 and FIG. 4, the holding shell 30 is of a rectangular frame shape and mounted in the receiving chamber 11 of the insulating housing 10 to abut against periphery inner sides of the receiving chamber 11, with the tongue board 12 stretching in the middle of the holding shell 30 and being apart from periphery plates 31 of the holding shell 30. The periphery plates 31 of the holding shell 30 are punched towards the tongue board 12 to form a plurality of elastic slices 33 of which each has one end connected with the periphery plate 31 and the other end freely arched towards the tongue board 12 to be acted as a holding portion 33*a* for firmly holding the mating connector. In this embodiment, front edges of the periphery plates 31 of the holding shell 30 are bent outward to wrap up front end edges of the receiving chamber 11.

Referring to FIGS. 1-4, the shielding cover 50 adapted for being connected to ground is punched from a metal board, and has a rectangular base board 54 with two rectangular windows 52 being apart opened therein and a plurality of contact strips 51 being formed and apart arranged to periphery edges of the base board 54. In the embodiment, the contact strips 51 freely extend slantwise upward from a top edge and two side edges of the base board 54 respectively. The top edge and a bottom edge of the base board 54 protrude rearward to form a plurality of locking slices 53 of which each has a locking hole 53*a* opened in a middle thereof. The base board 54 is covered onto the front surface 15 of the insulating housing 10 with the windows 52 being communicated with the front ends of the receiving chambers 11, by virtue of a plurality of locking blocks 14 being buckled in the locking holes 53*a* of the locking slices 53 respectively, wherein the locking blocks 14 are apart protruded on a top side and a bottom side of the insulating housing 10. The contact strips 51 stretch freely outside the insulating housing 10. Then, the shielding shell 40 is put around the insulating housing 10 and electrically connected with the shielding cover 50.

In the embodiment, the electrical connector 100 further includes a plurality of fortified plates 60. A plurality of inserting slots 12*a* is opened from rear to front in a rear of the insulating housing 10. Each inserting slot 12*a* has a rear end penetrate through a rear side of the insulating housing 10, and a front end further spread to the tongue board 12. The fortified plates 60 are inserted forward in the inserting slots 12*a* so as to strengthen the tongue boards 12.

As described above, the shielding cover 50 adapted for being connected to ground is covered on the front surface 15 of the insulating housing 10 to cooperate with the shielding shell 40 so as to effectively shield external electromagnetic interference. Furthermore, the contact strips 51 are formed and apart arranged to the periphery edges of the base board 54 and stretch freely outside the insulating housing 10 so as to achieve a good effect of filtering external electromagnetic interference. So, electromagnetic interference can be effectively avoided happening in the electrical connector 100.

What is claimed is:

1. An electrical connector, comprising:

an insulating housing having a front surface concaved rearward to define at least one receiving chamber with a tongue board being protruded forward in a substantial middle of the receiving chamber, a bottom side of the tongue board defining a plurality of terminal fillisters each longitudinally penetrating rearward through the insulating housing;

a plurality of electrical terminals each having a fastening arm fastened in a rear of the terminal fillister of the insulating housing, a contact arm extending forward from a front end of the fastening arm to be received in the terminal fillister with a free end thereof arching downward to elastically stretch into the receiving chamber, and a soldering tail extending downward from a rear end of the fastening arm to be located behind the insulating housing;

at least one holding shell of a frame shape mounted in the receiving chamber of the insulating housing and abutting against periphery inner sides of the receiving chamber, with the tongue board stretching in the holding shell and being apart from periphery plates of the holding shell;

a shielding cover adapted for being connected to ground and punched from a metal board, the shielding cover having a base board with at least one window being opened therein and a plurality of contact strips being formed and apart arranged to periphery edges of the base board, the base board being covered onto the front surface of the insulating housing with the window being communicated with an opened front end of the receiving chamber, the contact strips stretching freely outside the insulating housing; and a shielding shell put around the insulating housing and electrically connected with the shielding cover.

2. The electrical connector as claimed in claim 1, wherein the contact strips of the shielding cover freely extend slantwise upward from a top edge and two side edges of the base board respectively.

3. The electrical connector as claimed in claim 1, wherein a top edge and a bottom edge of the base board of the shielding cover protrude rearward to form a plurality of locking slices of which each has a locking hole opened in a middle thereof, a plurality of locking blocks is apart protruded on a top side and a bottom side of the insulating housing and buckled in the locking holes of the locking slices to secure the shielding cover to the insulating housing.

4. The electrical connector as claimed in claim 1, wherein front edges of the periphery plates of the holding shell are bent outward to wrap up front end edges of the receiving chamber of the insulating housing.

5. The electrical connector as claimed in claim 1, wherein the periphery plates of the holding shell are punched towards the tongue board to form a plurality of elastic slices of which each has one end connected with the periphery plate and the other end freely arched towards the tongue board to be acted as a holding portion for holding an external mating connector in the receiving chamber.

6. The electrical connector as claimed in claim 1, further comprising a plurality of fortified plates, a plurality of inserting slots being opened from rear to front in a rear of the insulating housing and each having a front end further spread to the tongue board, the fortified plates being inserted forward in the inserting slots to strengthen the tongue board.

* * * * *